US007745742B2

(12) United States Patent
Li et al.

(10) Patent No.: US 7,745,742 B2
(45) Date of Patent: Jun. 29, 2010

(54) BUTTON ASSEMBLY

(75) Inventors: Jiunn-Her Li, Taipei Hsien (TW); Shih-Chang Hsu, Taipei Hsien (TW); Tzu-Hsiu Hung, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 850 days.

(21) Appl. No.: 11/611,143

(22) Filed: Dec. 15, 2006

(65) Prior Publication Data

US 2007/0209921 A1 Sep. 13, 2007

(51) Int. Cl.
*H01H 9/26* (2006.01)

(52) U.S. Cl. ..... 200/5 R; 200/5 A

(58) Field of Classification Search ..... 200/5 R; 400/490

See application file for complete search history.

(56) References Cited

U.S. PATENT DOCUMENTS 5,523,531 A 6/1996 Ozaki
6,835,902 B2 * 12/2004 Hiraoka ..... 200/5 A

* cited by examiner

*Primary Examiner*—Renee Luebke
*Assistant Examiner*—Lisa Klaus
(74) *Attorney, Agent, or Firm*—Wei Te Chung

(57) ABSTRACT

A button assembly includes a first-button assembly (70), and a second-button assembly (80). The first-button assembly comprises a first button (72), and a first-supporting frame (74) used for supporting the first button. The first supporting frame includes a plurality of latching poles (78) projecting therefrom. The second-button assembly includes a plurality of second buttons (82) arranged around the first button, and a second-supporting frame 86 for supporting the second buttons. The second-supporting frame includes a plurality of latching holes 842 for receiving the latching poles. An electronic product having the button assembly is also disclosed.

15 Claims, 4 Drawing Sheets

BUTTON ASSEMBLY

BACKGROUND OF THE INVENTION

1. Field of the Invention

The present invention pertains to a button assembly, and particularly to a button assembly having a fixing frame for exact positioning of buttons.

2. Description of Related Art

Presently, an electronic product usually comprises a plurality of buttons for manual operation. The buttons are usually mounted through buttonholes in a shell of the electronic product, and attached to a circuit board to activate switches mounted on the circuit board.

However, because sizes of the buttonholes are usually greater than that of the buttons, and without any positioning configuration, the buttons may be loose in the button holes, resulting in unreliable electrical contact.

Therefore, a need exists in the industry to overcome the aforementioned deficiencies and inadequacies.

SUMMARY OF THE INVENTION

In an exemplary embodiment, a button assembly comprises a first-button assembly, and a second-button assembly. The first-button assembly is attached to a back of the second button assembly. The first-button assembly comprises a first button, a first-mounting frame defining a void therein with edges of the first-mounting frame surrounding the first button therein, and a plurality of first-supporting arms extending from the first-supporting frame and connecting with the first button for holding the first button in the void. The second-button assembly comprises a second-mounting frame defining a void therein, and a plurality of second buttons extending from the second-mounting frame into the void of the second frame. The first button passes through the void of the second-mounting frame and protrudes among the second buttons.

In another exemplary embodiment, an electronic product, includes a front cover having an opening therein, a button assembly, and a circuit board fixed to the front cover. The button assembly comprises a first-button assembly and a second-button assembly fixed with the front cover by heat staking. The first-button assembly comprises a first button, and a first-supporting frame used for supporting the first button. The first supporting frame includes a plurality of latching poles projecting therefrom. The second-button assembly includes a plurality of second buttons arranged around the first button, and a second-supporting frame for supporting the second buttons. The second-supporting frame includes a plurality of latching holes for receiving the latching poles. Wherein the button assembly is fixed between the front cover and the circuit board, and the first button and the second buttons are received in the opening of the front cover.

Other advantages and novel features will become more apparent from the following detailed description when taken in conjunction with the accompanying drawings, in which:

DETAILED DESCRIPTION OF THE INVENTION

Figure 1:
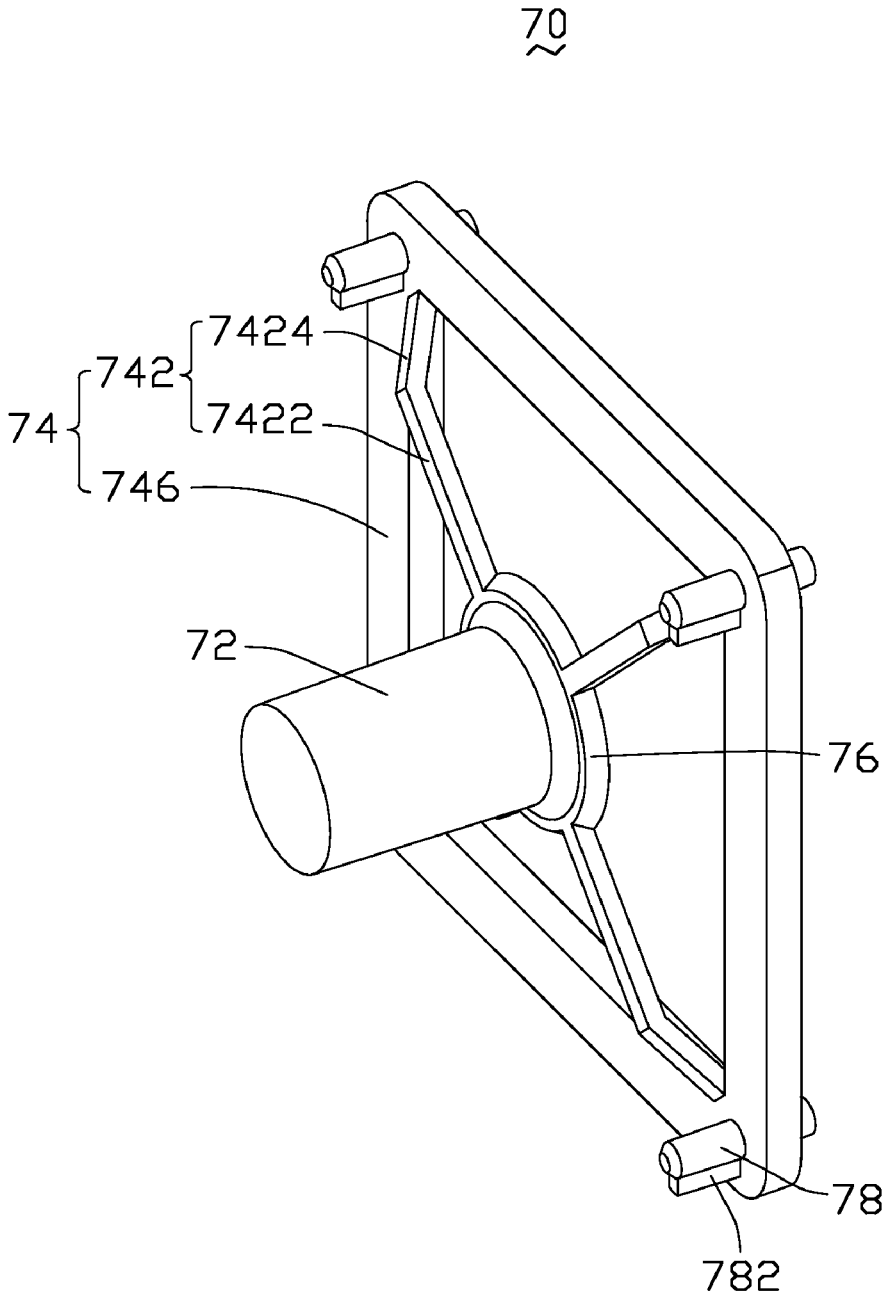
FIG. 1 is a perspective view of a first-button assembly of a button assembly in accordance with an exemplary embodiment of the present invention.

Referring to FIG. 1, a first-button assembly 70 of a button assembly used for an electronic product of the present invention is shown. The first-button assembly 70 comprises a first button 72, and a first-supporting frame 74 for supporting the first button 72. The first button 72 comprises a circular base 76 formed at a lower portion thereof. The first-supporting frame 74 comprises a rectangular first-mounting frame 746 defining a central void therein (in other embodiments, the first-mounting frame 746 can be in other shapes), with four first-frame edges 7462 surrounding the first button 72 in a middle of the first-supporting frame 74, and four first-supporting arms 742 respectively extending from four corners of the first-mounting frame 746 and connecting with the base 76 of the first button 72. The first-mounting frame 746 is thicker than the first-supporting arms 742. Each of the first-supporting arms 742 comprises a flat portion 7422 fixed to the base 76 of the first button 72 and parallel to a surface of the first-supporting frame 74, and an oblique portion 7424 connecting the first-supporting frame 74 with the flat portion 7422. That is, the first button 72 is protuberant on the first-button assembly 70. Four latching poles 78 respectively project from four corners of the first-supporting frame 74, with a latching block 782 projecting from a side of each latching pole 78. The latching poles 78 are parallel to the first button 72. In the exemplary embodiment, some characters or symbols are printed on a surface of the first button 72.

Figure 2:
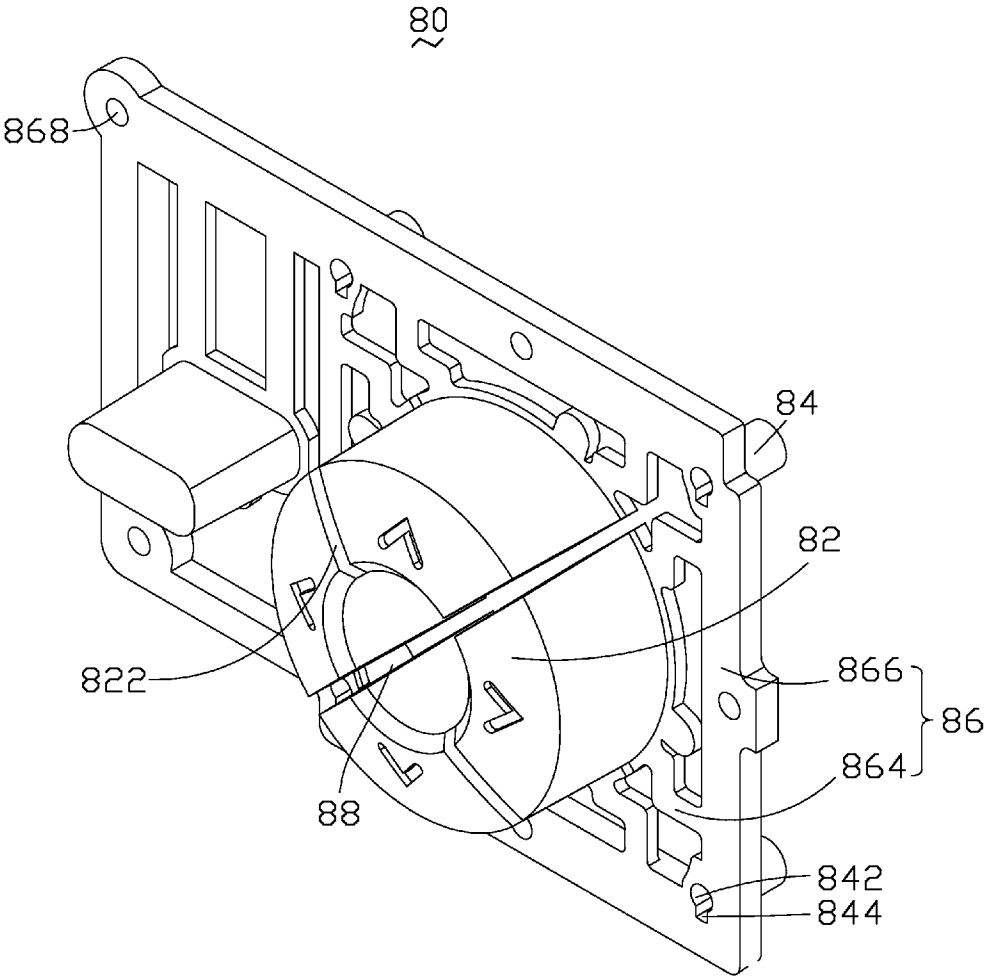
FIG. 2 is a perspective view of a second-button assembly of the button assembly in accordance with the exemplary embodiment of the present invention.
Figure 3:
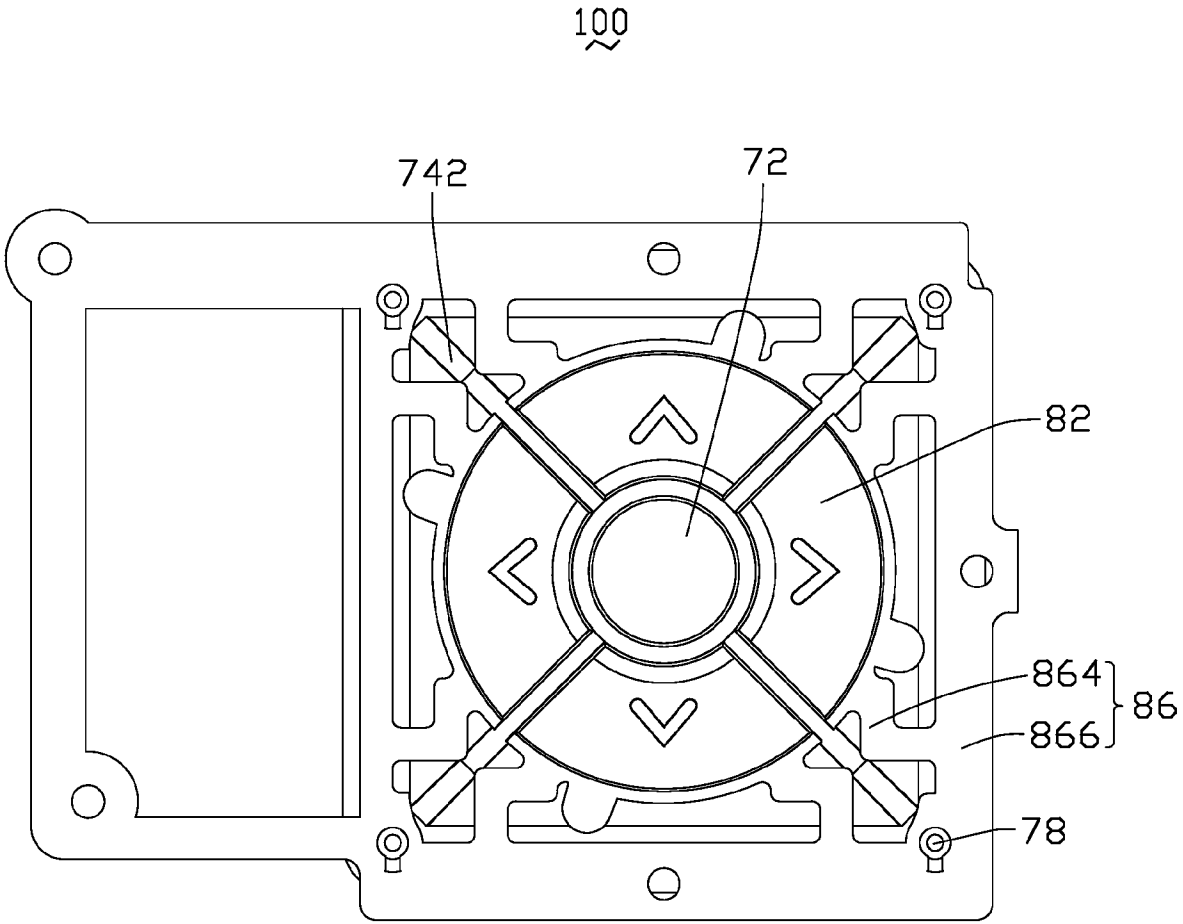
FIG. 3 is an assembled front view of the button assembly.

Referring to FIGS. 2 and 3, a second-button assembly 80 of the button assembly of the present invention is shown. The second-button assembly 80 comprises four second buttons 82 arranged around the first button, and a second-supporting frame 86 for supporting the second buttons 82. The second supporting frame 86 defines a central void therein so that each of the four second buttons 82 is formed by extending from the second supporting frame 86 into the central void of the second supporting frame 86. Between every two neighboring second buttons 82, a plurality of gaps 822 are defined, and the first-supporting arms 742 are respectively formed correspondingly to the gaps 822 as shelters of the gaps 22 for preventing a circuit board of the electronic product from being exposed. A receiving hole 88 is centrally formed among the second buttons 82 for receiving the first button 72. The second-supporting frame 86 comprises a second-mounting frame 866. Four mounting poles 84 respectively project from the second-mounting frame 866 towards the first-supporting frame 74. Each of the mounting poles 84 defines a latching hole 842 therein, with a slot 844 defined adjacent to and communicating with the latching hole 842. The latching holes 842 are used for receiving the latching poles 78 with the slots 844 corresponding to the latching blocks 782. The second-supporting frame 86 further comprises four pairs of second-supporting arms 864. Each of second-supporting arms 864 extends from a corresponding edge of the second-mounting frame 866 and is fixed to an adjacent second button 82. The second-mounting frame 866 is thicker than the second-supporting arms 864. The second-mounting frame 866 further comprises a plurality of mounting holes 868.

Figure 4:
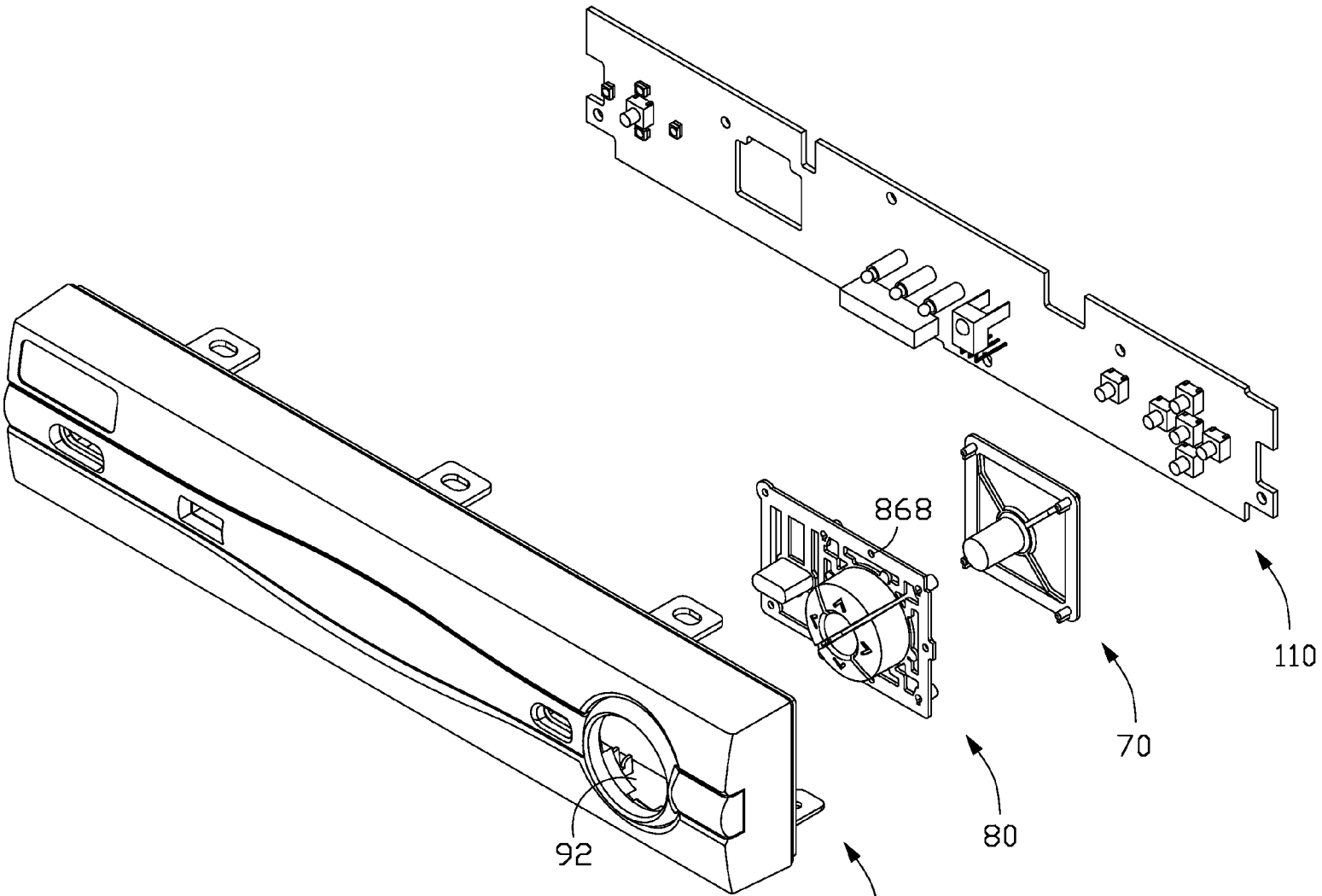
FIG. 4 is an exploded view of an electronic product comprising the button assembly of the present invention.

Referring to FIG. 4, an electronic product comprising the button assembly of the present invention is shown. The electronic product further comprises a front cover 90 and a circuit board 110 having a plurality of electronic components like switches (not labeled) mounted thereon. The front cover 90 comprises an opening 92 therein. The opening 92 is used for receiving the first button 72 and the second buttons 82 therein. A plurality of projecting poles (not shown) projects from a side of the front cover 90 corresponding to the mounting holes 868. In assembly, the second-button assembly 80 is mounted into the front cover 90, with the second buttons 82 being received in the opening 92 and the projecting poles being received in the mounting holes 868. The projecting poles are fixed in the mounting holes 868 by heat staking, to make the second-button assembly 80 fixed to the front cover 90.

The first-button assembly 70 is attached to a back of the second-button assembly 80. The first button 72 and latching poles 78 of the first-button assembly 70 are respectively inserted into the receiving hole 88 and latching holes 842 of the second-button assembly 80. Thereby, the mounting poles 84 abut against a surface of the first-button assembly 70, and the projecting blocks 782 are received in the slots 844.

The circuit board 110 is attached to a back of the first-button assembly 70, and a plurality of bolts (not shown) is used to fix the circuit board 110 to the front cover 90, thereby the first-button assembly 70 and the second button assembly 80 are fixed between the circuit board 110 and the front cover 90, with the first button 72 and the second buttons 82 being received in the opening 92 of the cover 90. Each of the first button 72 and the second buttons 82 therefore respectively correspond to the plurality of switches mounted on the circuit board 110 in order for activating the switches.

Since the latching poles 78 are respectively received in the latching holes 842, the first button 72 is fixed in a middle of the second buttons 82. In addition, with the latching block 782 of the latching poles 78 respectively received in the slots 844 of the latching holes 842, an orientation of the first button 72 is fixed thereby maintaining a desired orientation of the characters or symbols on the first button 72.

Because each of the second-supporting arms 864 is used to support only one of the second buttons 82, each second button 82 cannot interfere with the other second buttons 82 while being pressed.

When the first-button assembly 70 is mounted into the second-button assembly 80, because each first-supporting arms 742 of the first-button assembly 70 are formed correspondingly to one of the gaps 822 between every two neighboring second buttons 82, the first-supporting arms 742 help shelter the circuit board 110.

When one of the second buttons 82 is pressed, because the second-mounting frame 866 is thicker and therefore more rigid than the second-supporting arms 864, the rest of the second buttons 82 will not be effected.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A button assembly, comprising:

a first-button assembly, comprising a first button, and a first-mounting frame defining a void therein with edges of the first-mounting frame surrounding the first button therein, the first-mounting frame comprising a plurality of latching poles projecting therefrom, the first-button assembly further comprising a plurality of first-supporting arms extending from the first-mounting frame and connecting with the first button for holding the first button in the void;

a second-button assembly, the second-button assembly comprising a second-mounting frame defining a void therein, the second-mounting frame comprising a plurality of latching holes to cooperate with the latching poles for fixing the first-button assembly with the second-button assembly, the second-button assembly further comprising a plurality of second buttons extending from the second-mounting frame into the void of the second frame;

wherein the first-button assembly is attached to a back of the second-button assembly with the first button passing through the void of the second-mounting frame and protruding among the second buttons.

2. The button assembly as claimed in claim 1, wherein each of the latching poles comprises a latching block formed thereon, the second-supporting frame further defining a slot adjacent to and communicating with each latching hole for receiving the corresponding latching block.

3. The button assembly as claimed in claim 2, wherein the second-button assembly further defines a plurality of gaps between every two neighboring second buttons, and the first-supporting arms are formed correspondingly to the gaps as shelters of the gaps.

4. The button assembly as claimed in claim 1, wherein the first-supporting arms comprise a flat portion fixed to the first button, and an oblique portion connecting the first-supporting frame with the flat portion.

5. The button assembly as claimed in claim 1, wherein the second-supporting frame comprises a plurality of second-supporting arms and a second-mounting frame, each of the second-supporting arms extends from the second-mounting frame and are fixed to an adjacent one of the second buttons.

6. The button assembly as claimed in claim 5, wherein the second-mounting frame is thicker than the second-supporting arms.

7. An electronic product, comprising:

a front cover, comprising an opening;

a circuit board, fixed with the front cover;

a button assembly, comprising a first-button assembly fixed with the front cover, and a second-button assembly, the first-button assembly comprising a first button, and a first-supporting frame used for supporting the first button, the first-supporting frame comprising a plurality of latching poles projecting therefrom, the second-button assembly comprising a plurality of second buttons arranged around the first button, and a second-supporting frame used for supporting the second buttons, the second-supporting frame comprising a plurality of latching holes for receiving the latching poles; and wherein the button assembly is fixed between the front cover and the circuit board, and the first button and the second buttons are received in the opening of the front cover.

8. The electronic product as claimed in claim 7, wherein the second-mounting frame comprises a plurality of mounting poles abutting against the first-mounting frame, and the latching holes are respectively formed in the mounting poles.

9. The electronic product as claimed in claim 7, wherein each of the latching poles comprises a latching block formed thereon, the second-supporting frame further defining a slot adjacent to and communicating with each latching hole for receiving the corresponding latching block.

10. The electronic product as claimed in claim 7, wherein the first-supporting frame further comprises a first-mounting frame, and a plurality of first-supporting arms respectively extending from the first-mounting frame and fixed to the first button.

11. The electronic product as claimed in claim 10, wherein the second-button assembly further defines a plurality of gaps between every two adjacent second buttons.

12. The electronic product as claimed in claim 11, wherein the first-supporting arms are configured to correspond to the gaps.

13. The electronic product as claimed in claim 10, wherein the first-supporting arms comprise a flat portion fixed to the first button, and an oblique portion connecting the first-supporting frame with the flat portion.

14. The electronic product as claimed in claim 7, wherein the second-supporting frame comprises a plurality of second-supporting arms and a second-mounting frame, each of the second-supporting arms extend from the second-mounting frame and are fixed to the corresponding second button.

15. The electronic product as claimed in claim 14, wherein the second-mounting frame is thicker than the second-supporting arms.

* * * * *